US008181561B2

(12) United States Patent
Riggs et al.

(10) Patent No.: US 8,181,561 B2
(45) Date of Patent: May 22, 2012

(54) EXPLOSIVE DECOMPRESSION PROPULSION SYSTEM

(75) Inventors: Jeffrey L. Riggs, Pittsboro, NC (US); Vladislav Oleynik, Pittsboro, NC (US); Valery Borovikov, Saint Petersburg (RU); Gennadiy Albul, Pittsboro, NC (US)

(73) Assignee: Causwave, Inc., Pittsboro, NC (US)

( * ) Notice: Subject to any disclaimer, the term of this patent is extended or adjusted under 35 U.S.C. 154(b) by 70 days.

(21) Appl. No.: 12/476,555

(22) Filed: Jun. 2, 2009
(Under 37 CFR 1.47)

(65) Prior Publication Data

US 2012/0097144 A1 Apr. 26, 2012

Related U.S. Application Data

(60) Provisional application No. 61/130,547, filed on Jun. 2, 2008.

(51) Int. Cl.
*F41F 3/04* (2006.01)

(52) U.S. Cl. ..... 89/1.817; 89/1.8; 89/1.816; 102/370

(58) Field of Classification Search ..... 89/1.817, 89/1.34, 1, 4, 130–139; 102/370, 381
See application file for complete search history.

(56) References Cited

U.S. PATENT DOCUMENTS 421,306 A * 2/1890 Reynolds ..... 124/75
1,985,184 A * 12/1934 Methlin ..... 114/238
2,753,801 A * 7/1956 Cumming ..... 102/381
2,879,955 A * 3/1959 Von Zborowski ..... 244/3.22
2,927,398 A * 3/1960 Kaye et al. ..... 446/212
2,960,033 A * 11/1960 Jackson ..... 102/377
3,031,932 A * 5/1962 Fite, Jr. ..... 89/1.806
3,049,832 A * 8/1962 Joffe ..... 446/212
3,082,666 A * 3/1963 Fitzpatrick et al. ..... 89/1.806
3,135,163 A * 6/1964 Mechlin, Jr. et al. ..... 89/1.81
3,158,100 A * 11/1964 Finley ..... 102/377
3,167,016 A * 1/1965 Czerwinski et al. ..... 244/3.23

(Continued)

FOREIGN PATENT DOCUMENTS

EP 0559547 A1 9/1993

(Continued)

OTHER PUBLICATIONS

V. P. Korobeinikov (Propagation of shock and detonation waves in dust-laden gases, Journal: Fluid Dynamics, Publisher: MAIK Nauka/Interperiodica distributed exclusively by Springer Science+Business Media LLC., ISSN: 0015-4628 (Print) 1573-8507 (Online); Issue vol. 19, No. 6 / Nov. 1984; pp. 938-943).*

(Continued)

*Primary Examiner* — Benjamin P Lee
*Assistant Examiner* — Joshua Freeman
(74) *Attorney, Agent, or Firm* — R. Brian Drozd; Nelson Mullins Riley & Scarborough LLP

(57) ABSTRACT

A projectile propulsion system includes a launch tube, multiphase material, and a membrane. The launch tube has an interior cavity, the multiphase material disposed therein. The launch tube also has an opening to receive the multiphase material. The membrane seals the opening while the multiphase material is disposed in the interior cavity of the launch tube so as to allow the launch tube to be pressurized. When the membrane is broken, a supersonic wave thrusts the contents of the interior cavity, such as a projectile, outwards with a high velocity and force.

13 Claims, 15 Drawing Sheets

U.S. PATENT DOCUMENTS 3,167,061 A * 1/1965 Murray ..... 124/60
3,198,073 A * 8/1965 Van Tine et al. ..... 89/1.816
3,252,281 A * 5/1966 Everett et al. ..... 60/227
3,253,511 A * 5/1966 Zwicky ..... 89/1.814
3,313,207 A * 4/1967 Biehl et al. ..... 89/1.813
3,323,531 A * 6/1967 Spellman ..... 137/68.19
3,353,823 A * 11/1967 Sobel ..... 472/54
3,369,455 A * 2/1968 Jones ..... 89/1.818
3,397,638 A * 8/1968 Gould ..... 102/377
3,422,808 A * 1/1969 Weinberg et al. ..... 124/61
3,428,022 A * 2/1969 Ledley ..... 116/137 A
3,561,362 A * 2/1971 Black et al. ..... 102/374
3,620,123 A * 11/1971 Davidsson et al. ..... 9/1.8
3,633,560 A * 1/1972 DeFreitas ..... 124/56
3,715,983 A * 2/1973 Rosinski ..... 241/1
3,754,726 A * 8/1973 Rusbach ..... 244/3.28
3,842,598 A * 10/1974 Forsten ..... 60/259
3,916,794 A * 11/1975 Mayer ..... 102/489
4,038,115 A * 7/1977 Dehm ..... 149/19.8
4,185,538 A * 1/1980 Barakauskas ..... 89/1.81
4,333,402 A * 6/1982 Landstrom et al. ..... 102/505
4,373,420 A * 2/1983 Piesik ..... 89/1.812
4,389,938 A * 6/1983 Sigrist ..... 102/337
4,444,085 A * 4/1984 Dragonuk ..... 89/1.51
4,455,917 A * 6/1984 Shook ..... 89/1.817
4,584,925 A * 4/1986 Culotta et al. ..... 89/1.807
4,682,559 A * 7/1987 Schnitzer et al. ..... 114/295
4,784,035 A * 11/1988 Fishfader et al. ..... 89/1.34
H684 H * 10/1989 Arszman et al. ..... 102/377
4,932,306 A * 6/1990 Rom ..... 89/8
5,015,211 A * 5/1991 Reveen ..... 446/475
5,063,826 A * 11/1991 Bulman ..... 89/8
5,081,862 A * 1/1992 Merten, Jr. ..... 73/37
5,097,743 A * 3/1992 Hertzberg et al. ..... 89/7
5,099,645 A * 3/1992 Schuler et al. ..... 60/219
5,149,290 A * 9/1992 Reveen ..... 446/475
5,170,005 A * 12/1992 Mabry et al. ..... 89/1.81
5,174,384 A * 12/1992 Herman ..... 169/70
5,355,764 A * 10/1994 Marinos et al. ..... 89/8
5,440,993 A * 8/1995 Osofsky ..... 102/374
5,579,636 A * 12/1996 Rosenfield ..... 60/251
5,584,736 A * 12/1996 Salvemini ..... 441/85
5,623,113 A * 4/1997 Valembois ..... 89/1.817
5,652,405 A * 7/1997 Rakov ..... 89/7
5,833,393 A * 11/1998 Carnahan et al. ..... 405/79
5,847,307 A * 12/1998 Kennedy et al. ..... 89/1.817
5,864,517 A * 1/1999 Hinkey et al. ..... 367/145
5,909,000 A * 6/1999 Rakov ..... 89/7
5,927,329 A * 7/1999 Yie ..... 137/624.13
5,964,985 A * 10/1999 Wootten ..... 201/40
5,993,921 A * 11/1999 Hunn ..... 428/34.4
6,124,563 A * 9/2000 Witherspoon et al. ... 219/121.47
6,138,766 A * 10/2000 Finnerty et al. ..... 169/14
6,142,055 A * 11/2000 Borgwarth et al. ..... 89/1.817
6,225,705 B1 5/2001 Nakamats
6,257,340 B1 * 7/2001 Vician ..... 169/5
6,276,354 B1 * 8/2001 Dillon ..... 124/74
6,352,030 B1 * 3/2002 Doll et al. ..... 102/291
6,427,574 B1 * 8/2002 Callahan ..... 89/1.81
6,526,860 B2 * 3/2003 Facciano et al. ..... 89/1.801
6,550,074 B1 * 4/2003 Allenbaugh et al. ..... 4/255.11
6,752,060 B1 * 6/2004 Griffin ..... 89/1.817
6,854,409 B1 * 2/2005 Galliano ..... 114/238
6,979,021 B2 * 12/2005 Young et al. ..... 280/737
7,182,014 B2 * 2/2007 Smith ..... 89/16
7,267,230 B1 * 9/2007 Smith ..... 209/139.1
7,313,881 B1 * 1/2008 Gieseke et al. ..... 42/1.14
7,317,662 B2 * 1/2008 Unsworth et al. ..... 367/144
7,484,450 B2 * 2/2009 Hunn et al. ..... 89/1.818
7,617,818 B1 * 11/2009 T rchik et al. ..... 124/64
7,637,203 B2 * 12/2009 Moss ..... 92/140
7,685,920 B2 * 3/2010 Paul ..... 89/1.817
7,775,148 B1 * 8/2010 McDermott ..... 89/8
7,845,282 B2 * 12/2010 Sheridan et al. ..... 102/473
7,954,412 B2 * 6/2011 Jansson ..... 89/1.817
2001/0032638 A1 * 10/2001 Yoshimura ..... 124/81
2002/0096041 A1 * 7/2002 Briggs et al. ..... 89/1.817
2002/0189432 A1 * 12/2002 Facciano et al. ..... 89/1.801
2003/0089435 A1 * 5/2003 Sanderson et al. ..... 149/19.1
2004/0007123 A1 * 1/2004 Ritchie et al. ..... 89/1.14
2004/0074381 A1 * 4/2004 Smith ..... 89/16
2005/0139363 A1 * 6/2005 Thomas ..... 169/30
2006/0060692 A1 * 3/2006 Yehezkeli et al. ..... 244/3.21
2006/0090635 A1 * 5/2006 Paul ..... 89/1.817
2006/0096449 A1 * 5/2006 Williams et al. ..... 89/1.817
2006/0225716 A1 * 10/2006 Lapointe ..... 124/64
2007/0144506 A1 * 6/2007 Sun et al. ..... 124/67
2007/0251120 A1 * 11/2007 Connell ..... 34/576
2007/0251615 A1 * 11/2007 Amtower ..... 149/37
2009/0255432 A1 * 10/2009 Zhang et al. ..... 102/307
2010/0078004 A1 * 4/2010 Oleynik et al. ..... 124/73
2010/0251694 A1 * 10/2010 Hugus et al. ..... 60/253
2010/0282115 A1 * 11/2010 Sheridan et al. ..... 102/491

FOREIGN PATENT DOCUMENTS

GB 2058302 A * 4/1981
JP 2000-130991 A 5/2000
JP 2002316067 A 10/2002
JP 2004274942 A 9/2004
KR 20-0279401 Y1 6/2002
KR 100772493 B1 11/2007
RU 2063572 C1 7/1996
RU 2084260 C1 7/1997
SU 397794 A * 2/1974

OTHER PUBLICATIONS

Alfer'ev, K.V. et al., Mechanics of Autonomous Gas-Dynamic Torpedo Motion in Loose Medium, Journal of Mining Science, 2002, pp. 324-328, vol. 38, No. 4.

Borovikov, V.V., Development of a Containment Cavity in a Layer of Free-Flowing Material in Gaseodynamic Outburst from a Subsurface Gas Source, Journal of Mining Science, 1997, pp. 41-46, vol. 33, No. 1.

Borovikov, V.V. et al., Dynamics of a Soil Mass Subjected to a Deep Source of Gaseous Energy, Journal of Mining Science, 1995, pp. 51-55, vol. 31, No. 1.

Alfer'ev, K.V. et al.; The Effect of Rigid Boundaries on the Directionality of an Excavating Explosion; Combustion, Exposion, and Shock Waves; 2001; pp. 613-615: vol. 37, No. 5.

Borovikov, V.V. et al., Analysis of Energy Expenditures of Cold Gas on Ejection, Journal of Mining Science, 1995, pp. 364-365, vol. 31, No. 5.

Borovikov, V.V., Numerical Modeling of Gaseodynamic Processes in the Atmosphere Occurring with Detonation of a Vertical Deep-Hole Charge, Journal of Mining Science, 1995, pp. 427-432, vol. 31, No. 6.

Borovikov, V.V., Evaluation of Intensity of Loading in a Massif of Loose Material in the Zone of Action of an Underground Gaseodynamic Discharge, Journal of Mining Science, 1995, pp. 416-420, vol. 31, No. 6.

Borovikov, V.V., Numerical Modeling of the Magnitude of the Load on a Mass of Free-Flowing Material Subjected to the Action of a Gaseodynamic Source, Journal of Mining Science, 1997, pp. 348-355, vol. 33, No. 4.

Borovikov, V.V., Numerical Studies of Transportation of Granular Material by a Pin-Point Blast Using Models of the Mechanics of Continuous and Granular Media, Journal of Applied Mechanics and Technical Physics, 1998, pp. 1-11, vol. 39, No. 1.

Borovikov, V.V. et al., Gas-Dynamic Method of Decreasing the Force of Penetration of a Solid Into Ground, Journal of Applied Mechanics and Technical Physics, 1999, pp. 531-534, vol. 4, No. 3.

Borovikov, V.V. et al., Efficiency of Pulse Gas-Dynamic Technique of Pneumatic Transportation of Friable Materials, Journal of Mining Science, 1996, pp. 54-57, vol. 32, No. 1.

Borovikov, V.V et al.; The Use of Wave Effects of Pinpoint Underground Explosion; Combustion, Explosion, and Shock Waves; 2000; pp. 414-416; vol. 36, No. 3.

Borovikov V. Numerical investigations of transportation of loose material by directed explosion on the basis of models of solid and loose media mechanics. AMTP.-1998.—No. 1.

Borovikov V, Alferiev K, Lubarski S. Influence of rigid boundaries on directivity of outburst explosion. CESW, v.37, No. 5, 2001.

Borovikov V. Numerical modeling of intensity of loading of loose material body under the influence of the gas dynamical source. JMS.-1997.—No. 4.
Borovikov V. Development of camouflet space in the loose material layer at gas dynamical outburst out of an underground gas source. JMS.-1997.-No. 1.
Borovikov V, Alferiev K, Ebel A. Mechanics of movement of a pulse gas dynamical torpedo in loose medium. JMS.—No. 4, 2002.
Borovikov V, Guskov V, Sokolov A. Utilization of wave effects on directional explosions in ground. CESW, No. 3, 2000.
Borovikov V, Bystrov A. Pulse gas dynamical method of reducing the force of penetration of solid bodies into the ground. AMTP.—1999.—v.40.—No. 3.
Borovikov V, Ivanov A, Lubarski S, Pivak B. The efficiency of pulsed gas-dynamic method for transportation of granular materials. JMS.—1996.—No. 1.
Borovikov V. Numerical modeling of gas dynamical processes in atmosphere during the explosion of vertical well charge. JMS.—1995.—No. 6.
Borovikov V. Evaluation of the intensity of loading the loose material body in the influence zone of underground gas dynamical obstruct. JMS.—1995.—No. 6.
Borovikov V, Ivanov A, Gorbunkov A, Lubarski S. Analysis of energy consumption of a cool gas for performance of outburst work. JMS.—1995.—No. 5.
Borovikov V, Ivanov A, Lubarski S. Dynamics of the ground body under the influence of underground gas energy source. JMS.—1995.—No. 1.
Approximate calculation of throwing a massive body without packing by a two-phase flow Sadin, D.V.1; Sklyar, V.A.1, Fizika Goreniya i Vzryva, v 34, n 3, p. 117-120, May-Jun. 1998.
Throwing of a noncompacted massive body by the two-phase medium flow Sklyar, V.A.1, Fizika Goreniya i Vzryva, v 32, n. 3, p. 119-121, May-Jun. 1996.
Influence of channel recoil on the velocity of throwing of a massive solid body by a two-phase torrent of the bulk density Sklyar, V.A.1, Fizika Goreniya i Vzryva, v 32, n 6, p. 129-133.
International Preliminary Report on Patentability; Dec. 16, 2010; issued in International Patent Application No. PCT/US2009/045936.
International Search Report; Jun. 16, 2010; issued in International Patent Application No. PCT/US09/63173.
Written Opinion of the International Searching Authority; Jun. 16, 2010; issued in International Patent Application No. PCT/US09/63173.

* cited by examiner

EXPLOSIVE DECOMPRESSION PROPULSION SYSTEM

CROSS-REFERENCE TO RELATED APPLICATION

This application claims priority from provisional patent application having Ser. No. 61/130,547 and filed Jun. 2, 2008, the entire disclosure of which is incorporated herein by reference.

BACKGROUND OF THE INVENTION

Currently, projectile systems require combustible fuels which explode to propel an object. Such systems pollute the environment, use non-renewable resources, create dangerous explosions, and are expensive.

There is a need to create a projectile propulsion system.

SUMMARY

In accordance with an aspect of the present invention, a projectile propulsion system includes a launch tube, multiphase material, and a membrane. The launch tube has an interior cavity, the multiphase material disposed therein. The launch tube also has an opening to receive the multiphase material. The membrane seals the opening while the multiphase material is disposed in the interior cavity of the launch tube so as to allow the launch tube to be pressurized.

In some embodiments, when the membrane is broken, a supersonic wave thrusts the contents of the interior cavity, such as a projectile, outwards with a high velocity and force.

Other aspects and features of the present invention, as defined solely by the claims, will become apparent to those ordinarily skilled in the art upon review of the following non-limited detailed description of the invention in conjunction with the accompanying figures.

DETAILED DESCRIPTION

Embodiments of the present invention are described below with reference to flowchart illustrations and/or block diagrams of method and apparatus (systems). It will be understood that each block of the flowchart illustrations and/or block diagrams, and/or combinations of blocks in the flowchart illustrations and/or block diagrams, can be controlled by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

Figure 1:
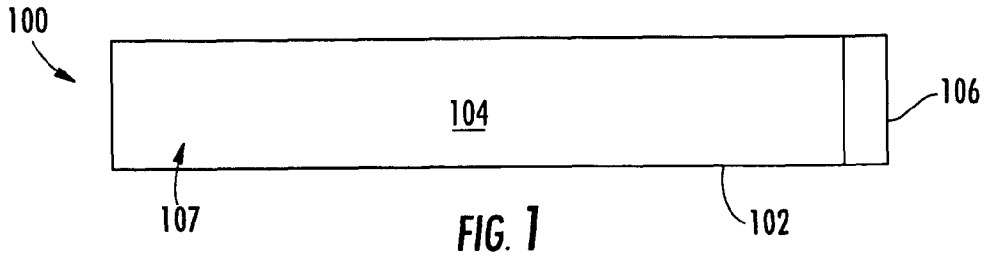
FIG. 1 is a projectile propulsion system in accordance with an embodiment of the present invention.

FIG. 1 is a projectile propulsion system 100 in accordance with an embodiment of the present invention. The projectile propulsion system 100 includes a launch tube 102, multiphase material (MPM) 104 and a membrane 106. The launch tube 102 may be any container which is capable of holding material (e.g. MPM 104) and capable of being pressurized. The launch tube 102 has an interior cavity 107 for receiving such material. The launch tube 102 may be of any shape or size. For example, the launch tube 102 may be a cylindrical shape, as shown in FIG. 1. The launch tube 102 may be of any size including a hand-held device or a large aerospace rocket. At least a portion of the launch tube 102 is initially hollow. Any type of materials that make up the body of the launch tube, including metals (e.g. steel, aluminum, etc.), plastic (e.g. PVC) and the like. In one embodiment, the launch tube 102 is a hollow pipe or a plastic tube. The launch tube has at least one opening 108 to receive MPM 104 and/or pressurized air/gas.

The MPM 104 is any material having a mulitphased composite structure. An example of such MPM 104 includes sand. In one embodiment, MPM 104 includes any material which has a multiplicity of elements bonded together such that when such bond is broken energy is released. The MPM 104 has porosity greater than 0 but less or equal to 1. At least a portion or all of the interior cavity 107 of the launch tube 102 is filled with MPM 104.

The membrane 106 is a device which seals the launch tube 102 by covering the opening 108 of the launch tube 102. The membrane 106 may be made of any material, including plastic, rigid materials, elastic, or any other material. In one embodiment, the membrane 106 is a material which is allowed to be ripped or compromised in response to a predetermined trigger, such as heat, ignition, sharp object, and the like. In another embodiment, the membrane 106 may be a door or other apparatus which may be removable from the opening 108 of the launch tube 102. The membrane 106 is secured to the launch tube 102 via any manner, such as glue, fasteners, hinge, friction, cap, and the like, to removably seal the launch tube 102. In one embodiment, multiple membranes (not shown) may be employed to cover multiple openings (not shown).

Figure 2:
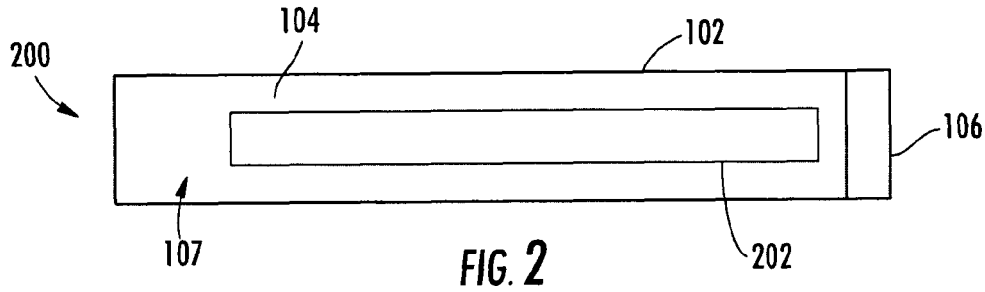
FIG. 2 is a projectile propulsion system in accordance with another embodiment of the present invention.

FIG. 2 is another projectile propulsion system 200 in accordance with another embodiment of the present invention. FIG. 2 illustrates the projectile propulsion system 100 of FIG. 1 with a projectile 202 inserted in the interior cavity 107 of the launch tube 102. At least a portion of the projectile 202 is surrounded by MPM 104. For example, as illustrated, the projectile 202 is completely surrounded by MPM 104.

Figure 3:
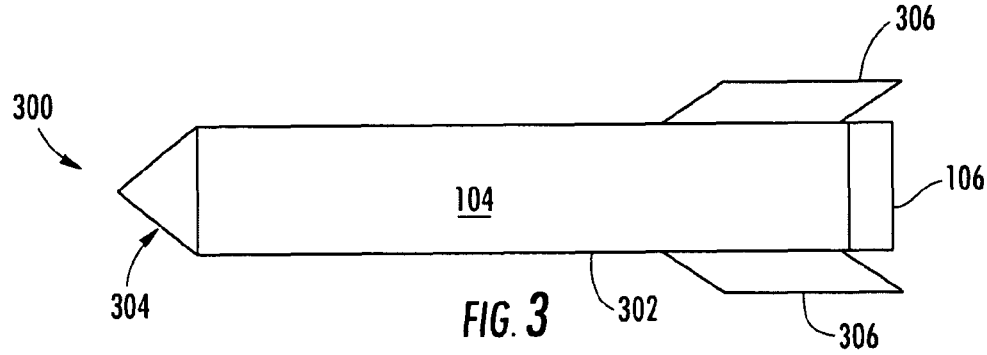
FIG. 3 is a projectile propulsion system in accordance with another embodiment of the present invention.

FIG. 3 is a projectile propulsion system 300 in accordance with another embodiment of the present invention. FIG. 3 illustrates the projectile propulsion system 100 of FIG. 1 with a launch tube 302 having at least one characteristic of a rocket. For example, as illustrated, the launch tube 302 has an aerodynamic shape (e.g. pointed front 304) and fins 306 to direct the launch tube. It should be noted that no projectile in located in the launch tube 302 through space.

Figure 4:
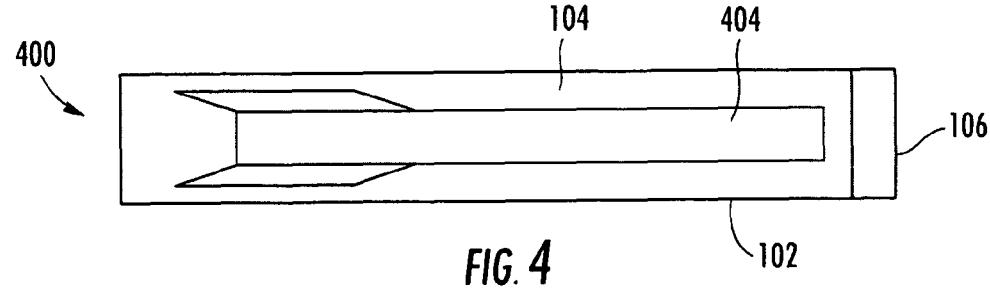
FIG. 4 is a projectile propulsion system in accordance with another embodiment of the present invention.

FIG. 4 is a multiphase projectile propulsion system 400 in accordance with another embodiment of the present invention. FIG. 2 illustrates the projectile propulsion system 100 of FIG. 1 with a projectile 404 inserted in the interior cavity 107 of the launch tube 102. The projectile 404 is another projectile propulsion system similar to the projectile propulsion system of FIG. 2. Both the interior cavity 102 of the projection propulsion system 400 and the interior cavity 406 of the imbedded projectile propulsion system 404 include MPM 104.

Figure 5B:
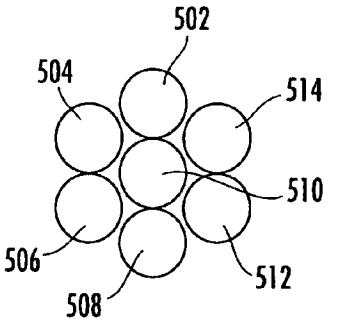
FIGS. 5A-B (collectively FIG. 5) is a multistage projectile propulsion system in accordance with another embodiment of the present invention.
Figure 5A:
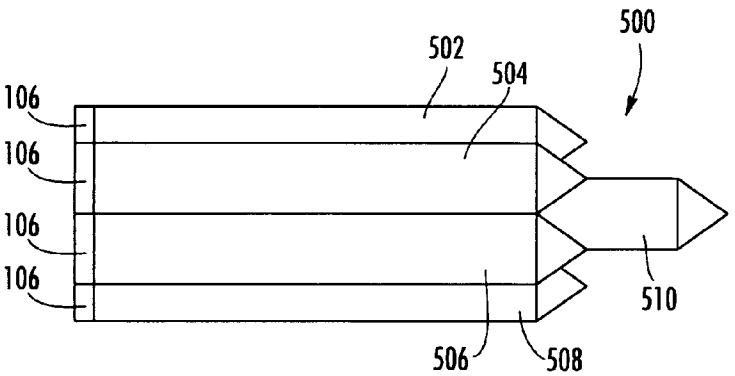

FIGS. 5A-B (collectively FIG. 5) is a multistage projectile propulsion system 500 in accordance with another embodiment of the present invention. FIG. 5A illustrates a plurality of active propulsion systems 502, 504, 506, 508, 510, 512, and 514, each similar to the propulsion system 300 of FIG. 3. Specifically, as illustrated in FIG. 5B, seven projectile propulsion systems 502, 504, 506, 508, 510, 512, and 514 are attached together to form a single multistage projectile propulsion system 500. Three of the projectile propulsion systems 502, 504, 506 of the multistage projectile propulsion system are paired together with three other projectile propulsion systems 508, 512, 514, respectively. The center projectile propulsion system 510 is not paired in the exemplary illustration.

Figure 6:
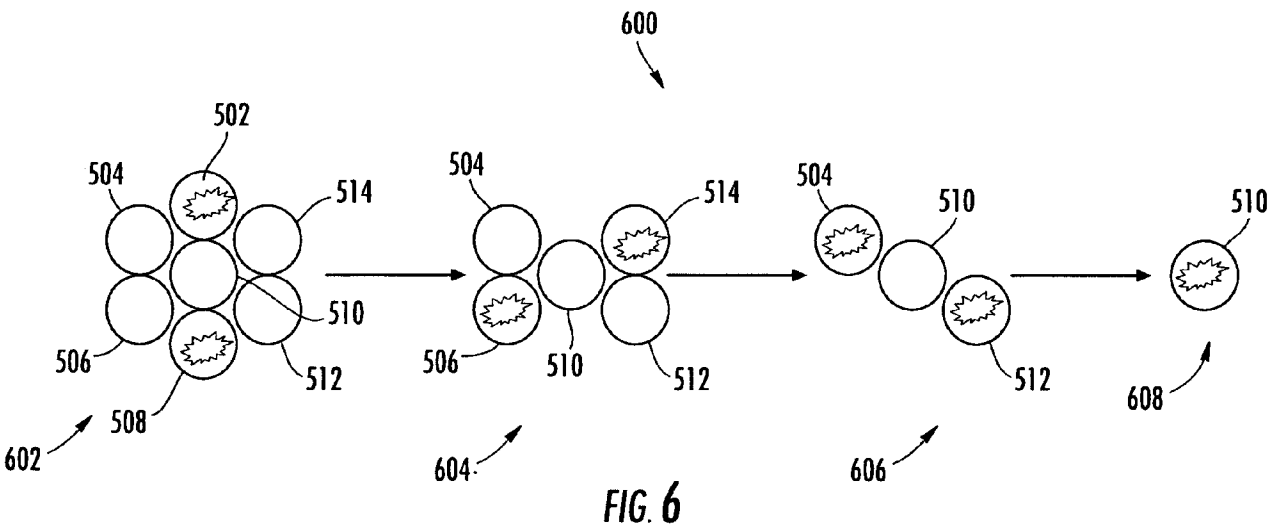
FIG. 6 illustrates a method of operation of the multistage projectile propulsion system of FIG. 5 in accordance with an embodiment of the present invention.

FIG. 6 illustrates a method 600 of operation of the multistage projectile propulsion system 500 of FIG. 5 in accordance with an embodiment of the present invention. In the first stage 602 of the multistage projectile propulsion system 600, the first pair of projectile propulsion systems 502, 508 is activated. After the first pair 502, 508 is activated, the second pair of projectile propulsion systems 506, 514 is activated in a second stage 604. Thereafter, for a third stage 606, the third pair 504, 512 of projectile propulsion systems is activated. For the last stage 608, the center projectile propulsion system 510 is activated. It should be understood that any of the above activations 602-608 of the projectile propulsion systems of the multistage projectile propulsion system 600 may be activated in different orders and/or simultaneously with any other stage(s) 602-608. Additionally, any number of stages may be included in the multistage projectile propulsion system.

Figure 7:
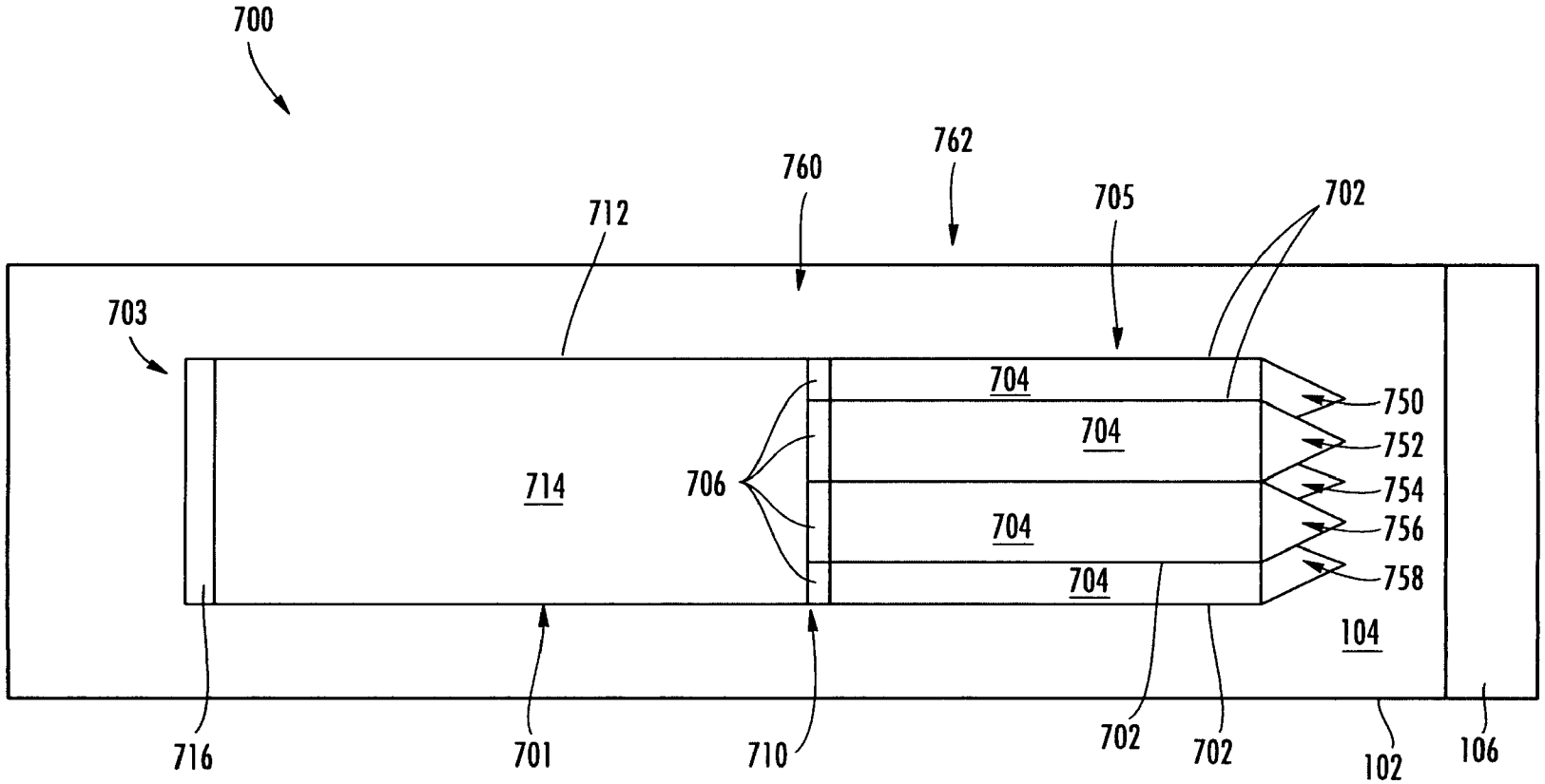
FIG. 7 is a multistage projectile propulsion system in accordance with another embodiment of the present invention.

FIG. 7 is another multistage projectile propulsion system 700 in accordance with another embodiment of the present invention. FIG. 7 includes a double multistage projectile propulsion system 703, which includes a thrust projectile propulsion system 701 attached to a multistage projectile propulsion system 705. The thrust projectile propulsion system 704 is similar to the projectile propulsion system 100 of FIG. 1 and includes a MPM 714, launch tube 712, a membrane 716, and an attachment means 710, such as adhesive, releasably fasteners, etc., to attach to the multistage projectile propulsion system 705. The multistage projectile propulsion system 705 is similar to the multistage projectile propulsion system 500 of FIG. 5 and each projectile propulsion system 750-758 of the multistage projectile propulsion system 705 includes MPM 704, launch tube 702, and a membrane 706. The double multistage projectile propulsion system 703 is located in an interior cavity 760 of a launching projectile propulsion system 762, which is similar to the projectile propulsion system of FIG. 1. The launching projectile propulsion system 762 includes MPM 104, launch tube 102, and a membrane 106. To launch the double multistage projectile propulsion system 703 of FIG. 7 the launching projectile propulsion system 762 is first activated. After the double multistage projectile propulsion system 703 is launched a predetermined time or distance from the launching projectile propulsion system 762, the thrust projectile propulsion system 701 is activated. After the thrust projectile propulsion system 701 is activated for a predetermined time, the multistage projectile propulsion system 705 is activated, similar to that described above with regard to FIG. 6. The description of how to operate or activate each projectile propulsion system 762, 701, 750-758 is described below with reference to FIG. 9.

Figure 8:
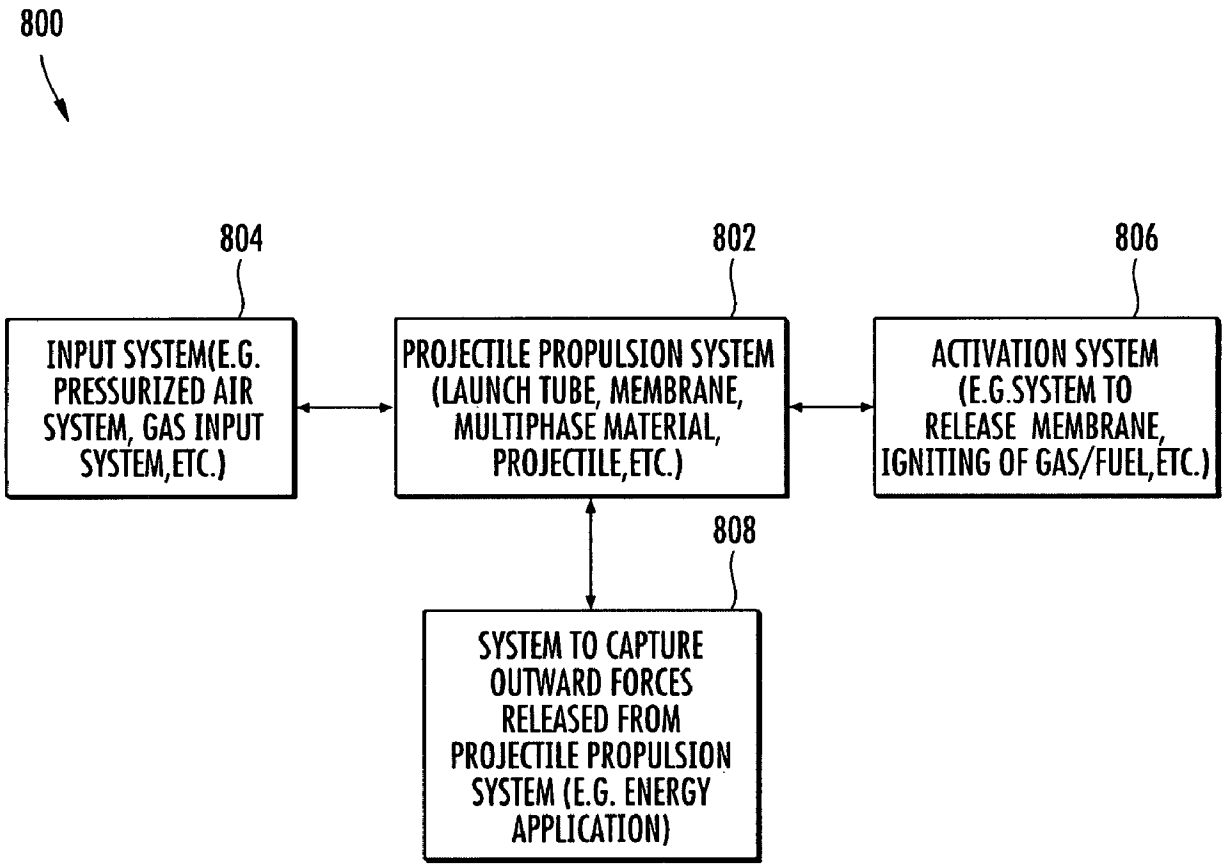
FIG. 8 is a block schematic diagram of an example of a system for projectile propulsion in accordance with an embodiment of the present invention.

FIG. 8 is a block schematic diagram of an example of a system 800 for projectile propulsion in accordance with an embodiment of the present invention. The system 800 includes at least one projectile propulsion system 802, as previously described with respect to FIGS. 1-7. Also, the system 800 may include one or more input systems 804, such as a system to pressurize the projectile propulsion system 802 with air, gas and the like. The input system 804 may be connected to any portion of the projectile propulsion system 802, including any opening or valve. Additionally, the system 800 may include an activation system 806, which releases the membrane to allow a sudden equalization of pressure between the interior cavity and the exterior of the projectile propulsion system 802. The system 800 may further include a system 808 to capture outward forces released from the projectile propulsion system 802. For example, the capture system 808 may capture MPM expelled from the interior cavity of the projectile propulsion system 802.

Figure 9:
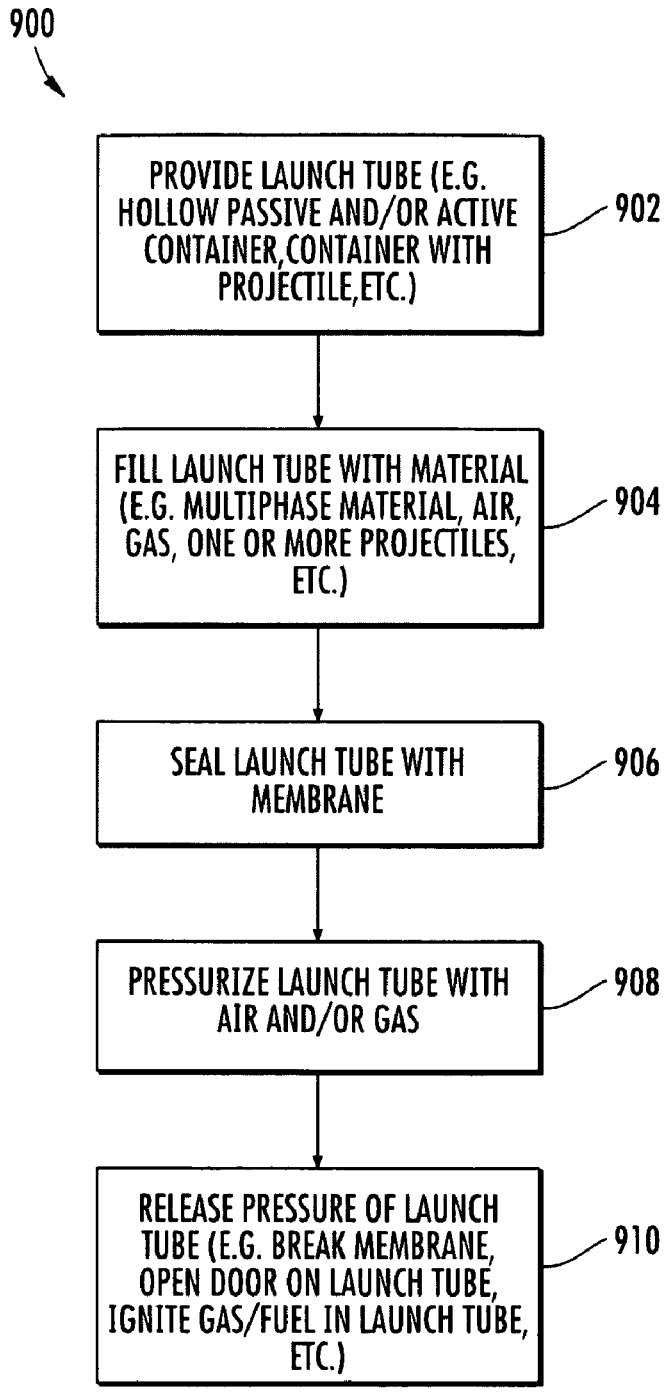
FIG. 9 is a method of operation of a projectile propulsion in accordance with an embodiment of the present invention.

FIG. 9 is a method 900 of operation of any projectile propulsion system in accordance with an embodiment of the present invention. In block 902, a launch tube is provided. As previously discussed, the launch tube may be a hollow container capable of receiving MPM and capable of being pressurized. In block 904, the launch tube is filled with material, such as MPM, projectiles, other projectile propulsion systems, or any other material and/or device. In block 906, the launch tube is sealed with a membrane so as to form an airtight seal. In block 908, the launch tube is pressurized by adding air and/or gas to the launch tube to achieve a predetermined pressure in the cavity. In block 910, the pressure of the launch tube is released by, for example, breaking the membrane, opening a door on the launch tube, igniting gas/fuel in the launch tube, heating the launch tube and/or membrane, and any other way to allow the launch tube to release pressure. By equalizing the pressure of the exterior of the launch tube with the interior cavity of the launch tube, a supersonic wave travels down the longitudinal length in the interior cavity of the launch tube and then travels back up the launch tube toward the opening of the launch tube pushing out any projectile and at least some MPM therein. Additionally, energy from the MPM may be released contributing to the supersonic wave.

Figure 10A:
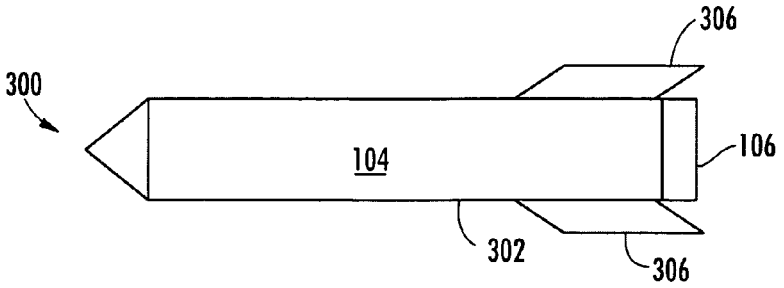
FIGS. 10A-B illustrates a method of operation of the projectile propulsion system of FIG. 3.
Figure 10B:
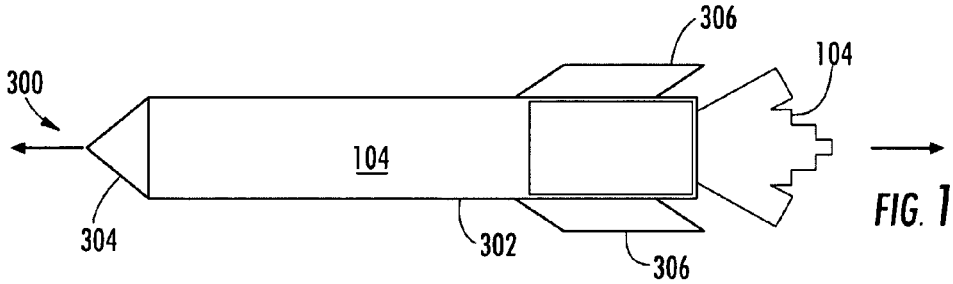

FIGS. 10A-B visually illustrates an exemplary method of operation of the projectile propulsion system 300 of FIG. 3. FIG. 10A illustrates the projectile propulsion system 300 of FIG. 3 after pressurization. FIG. 10B illustrates the projectile propulsion system 300 immediately after the membrane 106 is broken, resulting in MPM 104 thrust in a first direction and the launch tube propelled in an opposite direction. As shown, the MPM 104 is released from the interior cavity of the launch tube 302.

Figure 11A:
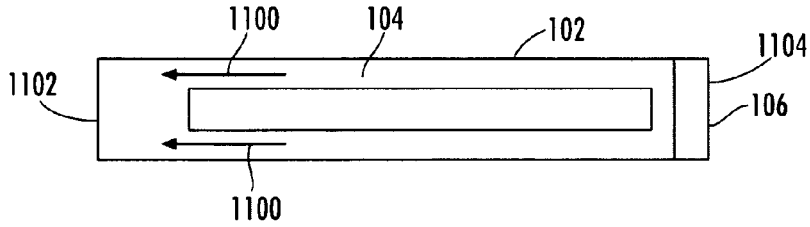
FIGS. 11A-C illustrates a method of operation of the projectile propulsion of FIG. 2.
Figure 11B:
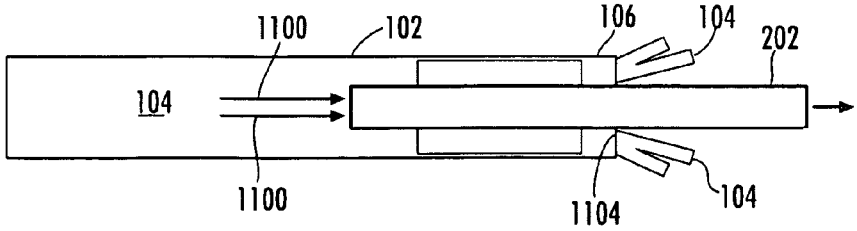
Figure 11C:
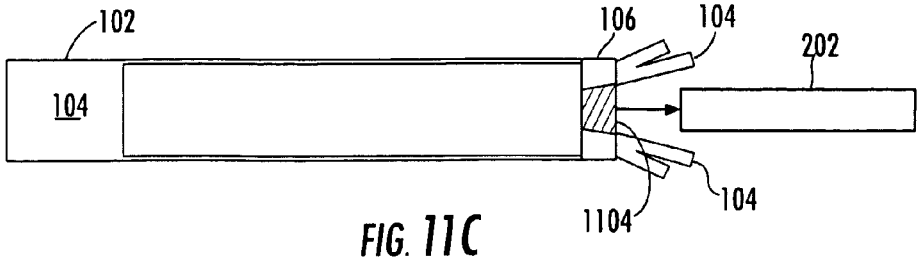

FIGS. 11A-C illustrates an exemplary method of operation of the projectile propulsion system 200 of FIG. 2. FIG. 11A illustrates the projectile propulsion system 200 of FIG. 2 when the membrane 106 of projectile propulsion system 200 is first broken. As shown, a supersonic wave 1100 travels down the longitudinal length of the launch tube 102 toward the end 1102 of the launch tube 102. After the supersonic wave 1100 reaches the end 1102 of the launch tube 102, the supersonic wave 1100 travels back toward the opening 1104 of the launch tube 102 propelling the projectile 202 of the projectile propulsion system 200, as shown in FIG. 11B. MPM 104 is shown as being expelled out of the launch tube 102 along with the projectile 202. As illustrated in FIG. 11C, the projectile 202 is forced completely out of the launch tube 102 with a tremendous amount of force and velocity.

Figure 12:
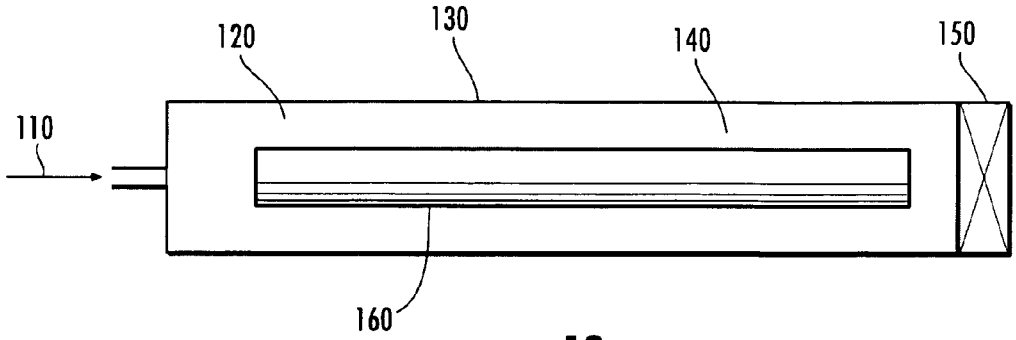
FIGS. 12-36 illustrate a cross-sectional view of the projectile propulsion system according to various embodiments of the present invention.
Figure 13:
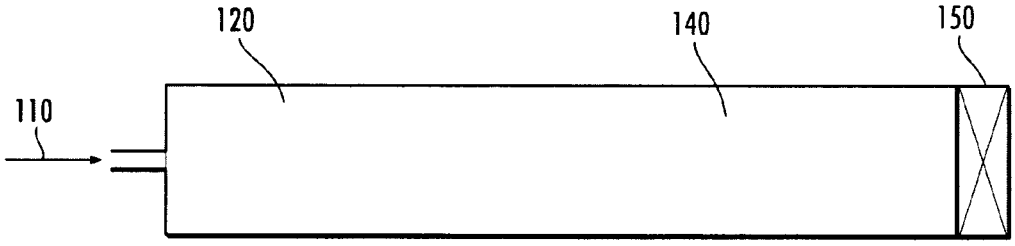
Figure 14:
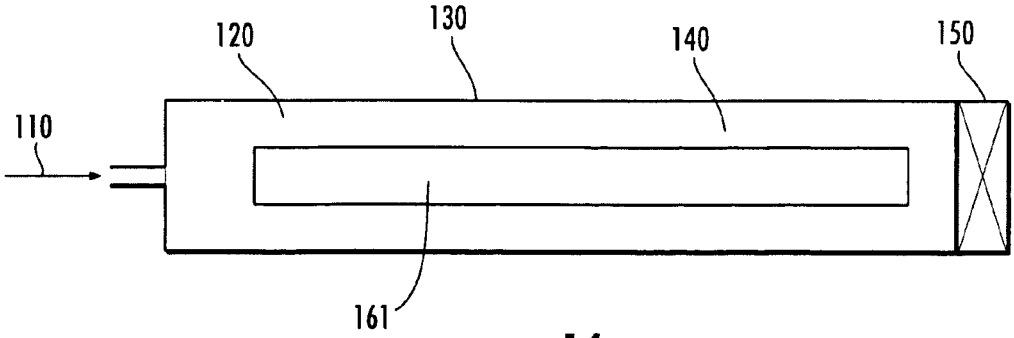
Figure 15:
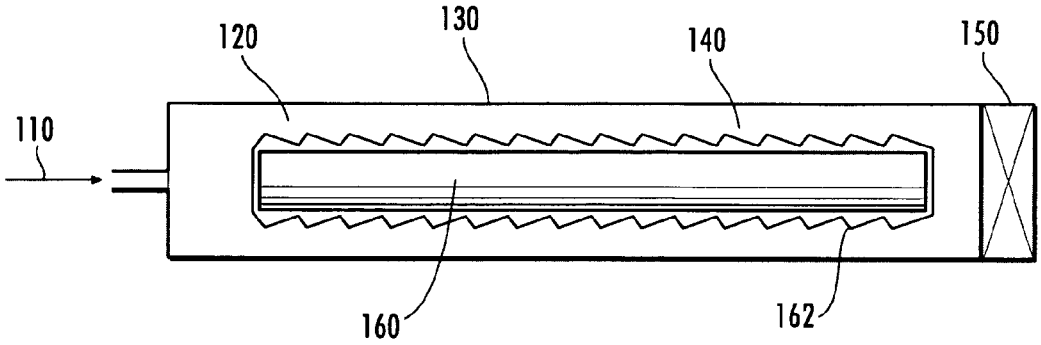
Figure 16:
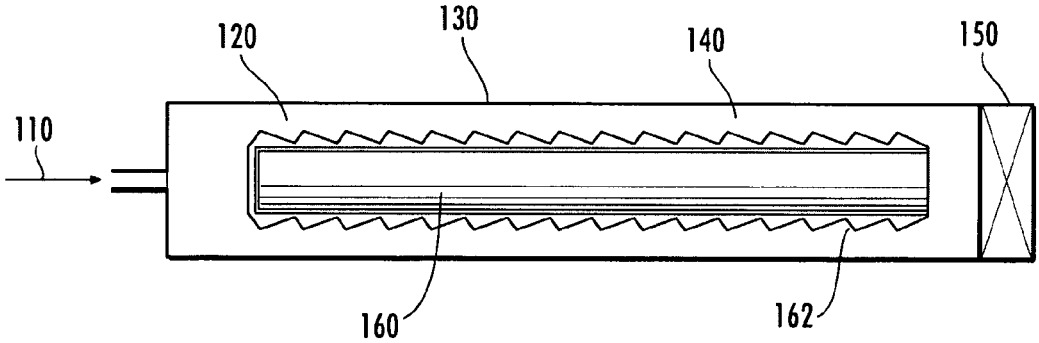
Figure 17:
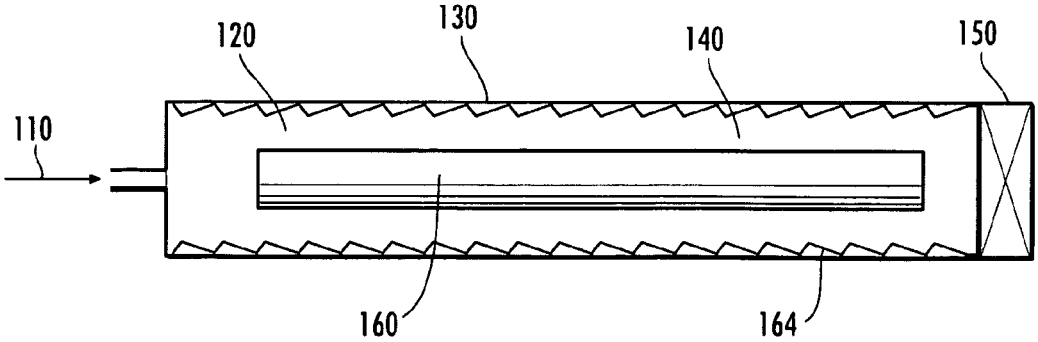
Figure 18:
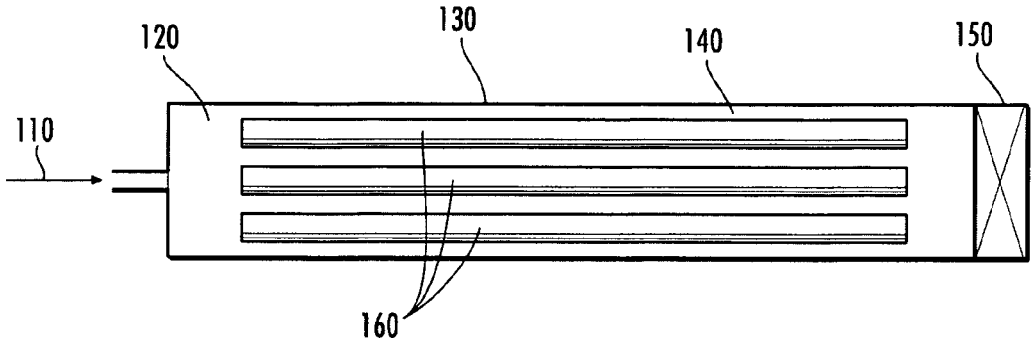
Figure 19:
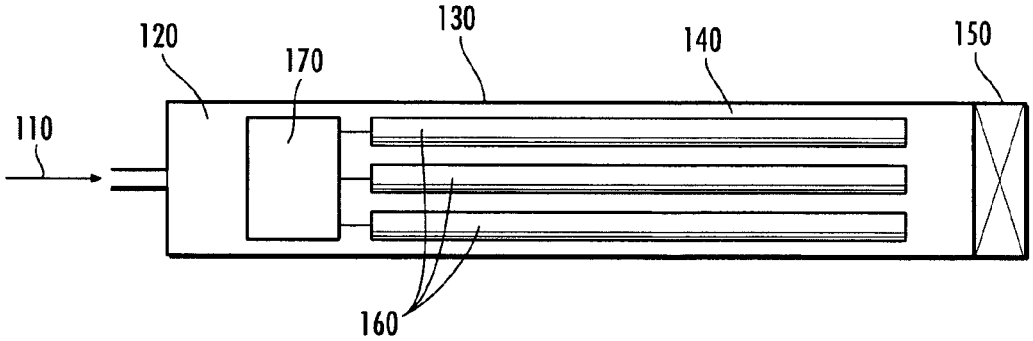
Figure 20:
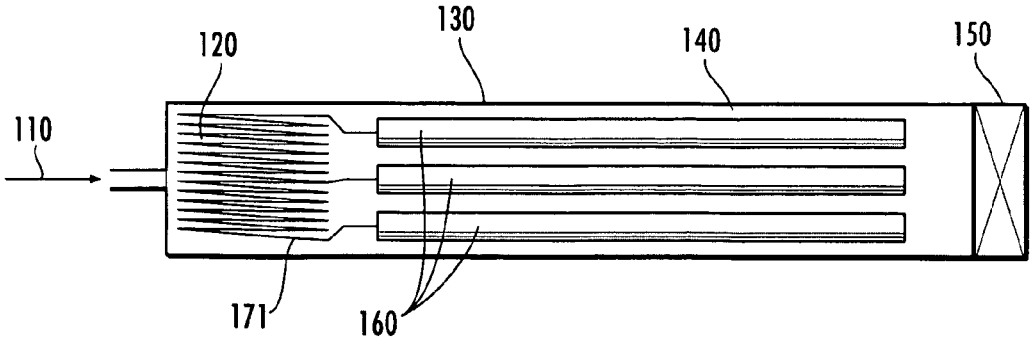
Figure 21:
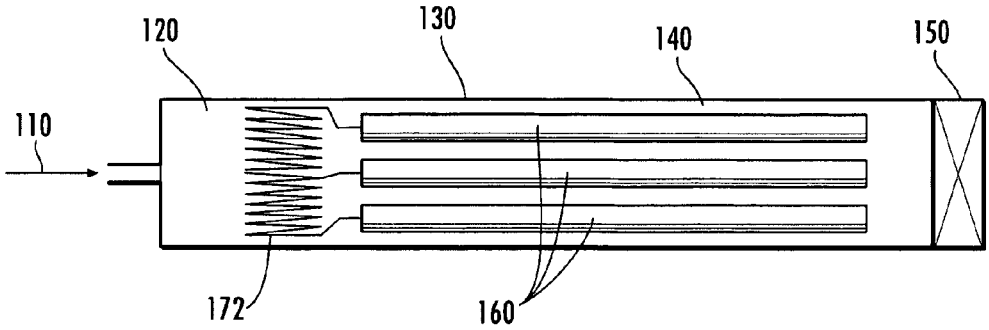
Figure 22:
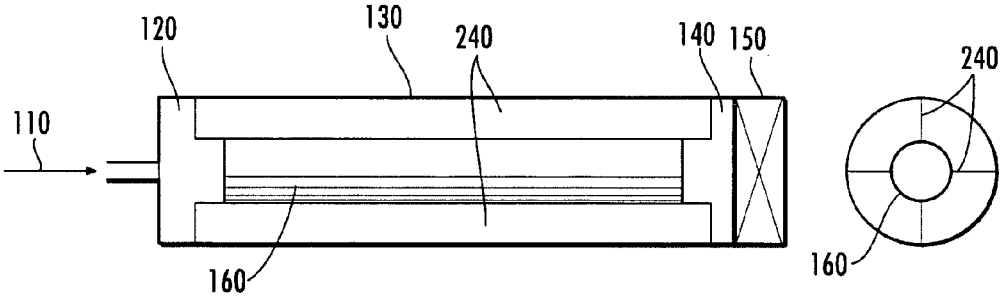
Figure 23:
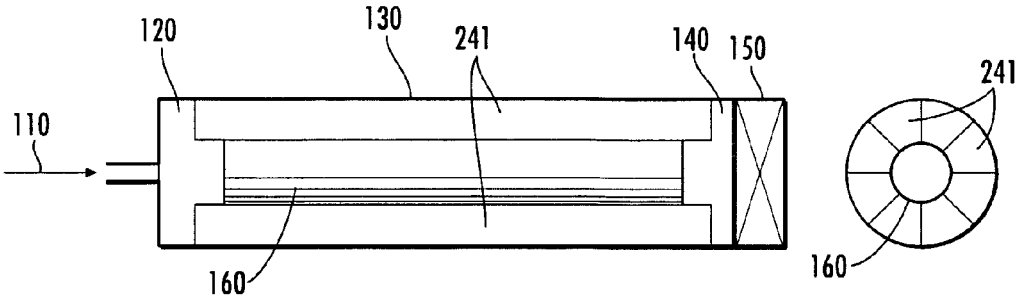
Figure 24:
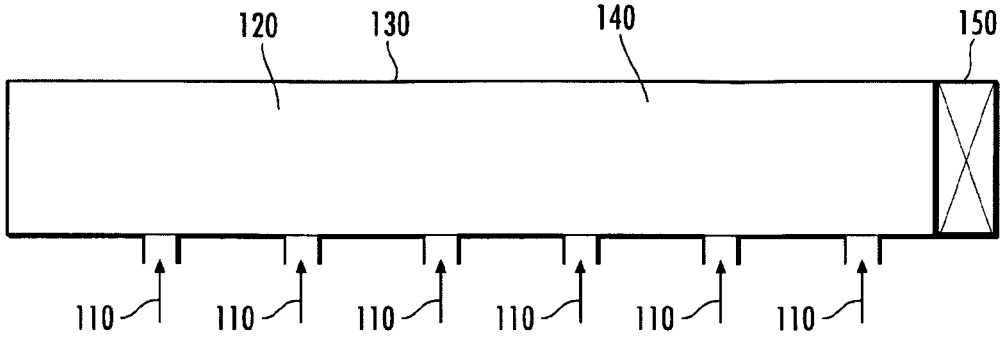
Figure 25:
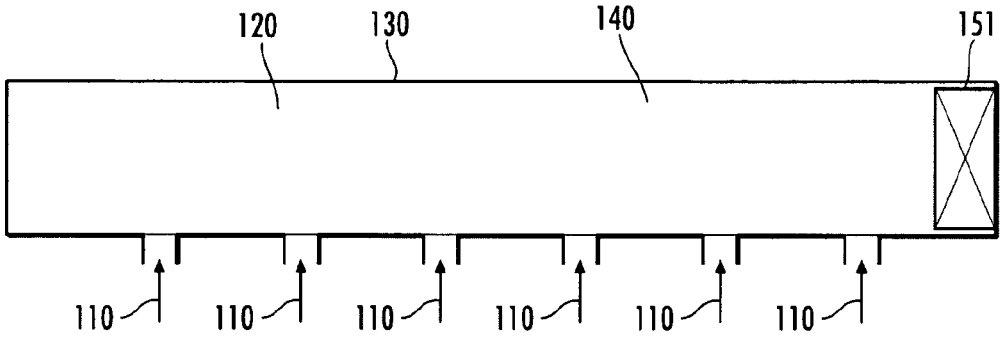
Figure 26:
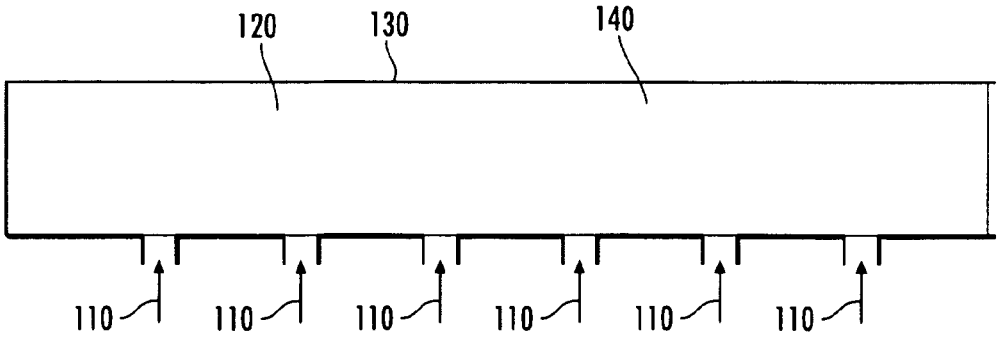
Figure 27:
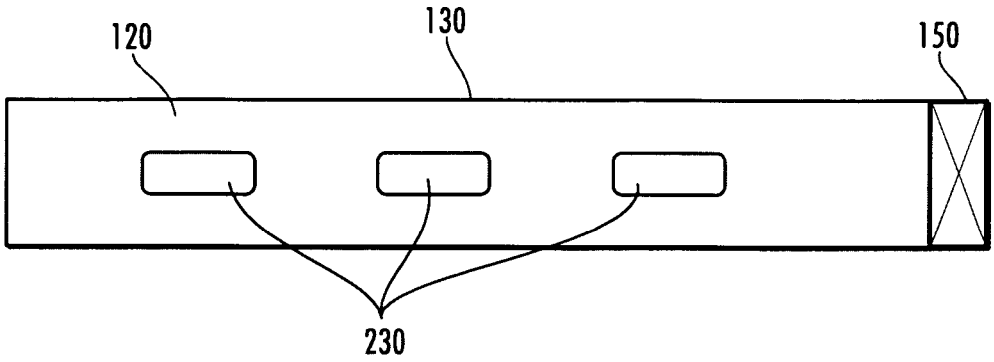
Figure 28:
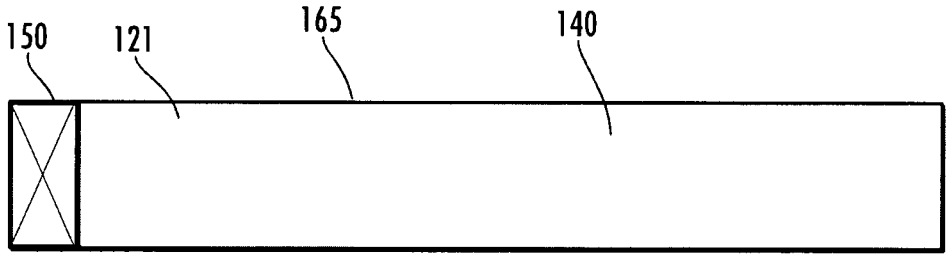
Figure 29:
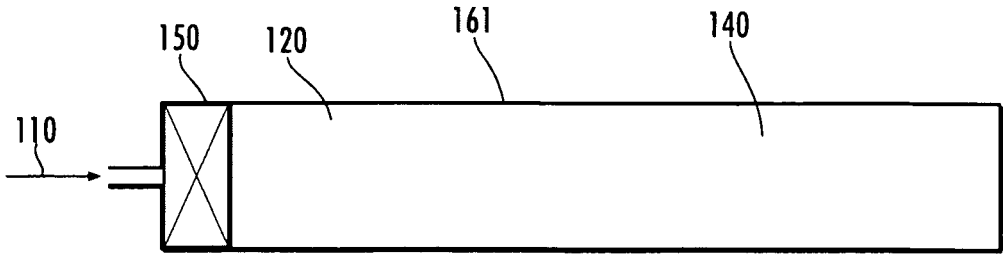
Figure 30:
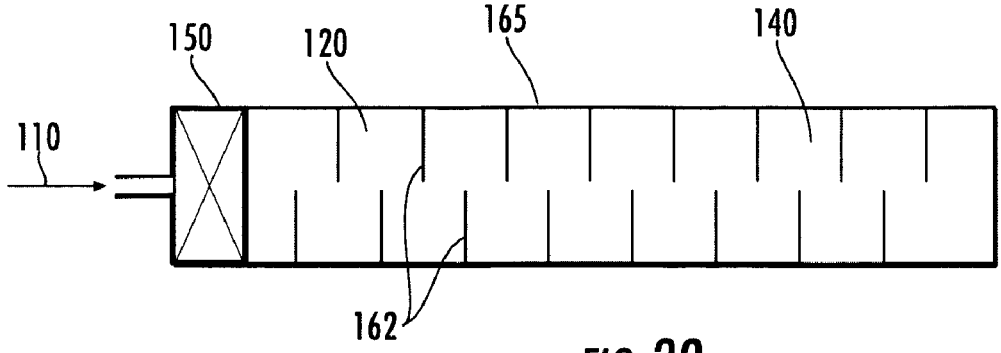
Figure 31:
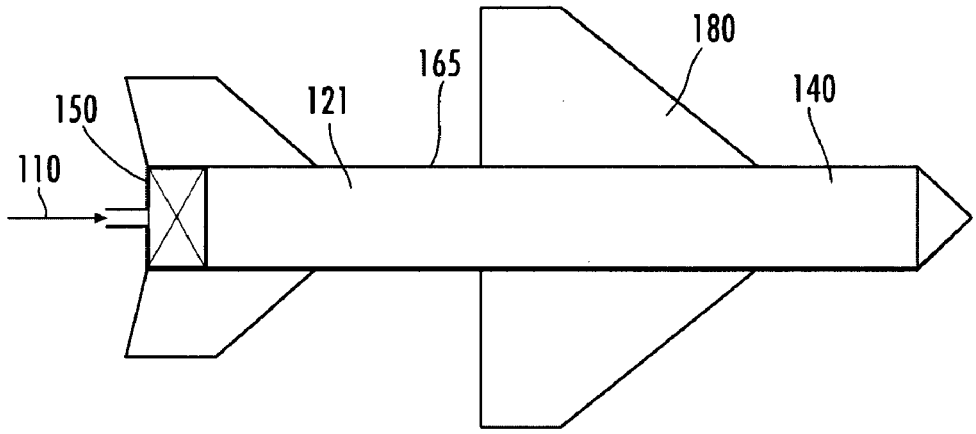
Figure 32:
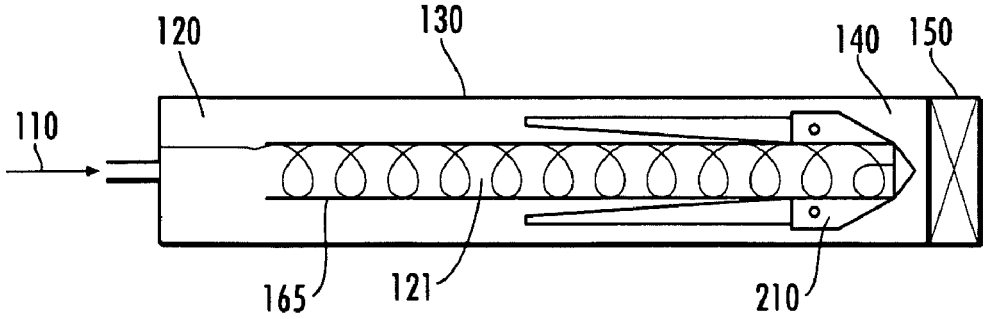
Figure 33:
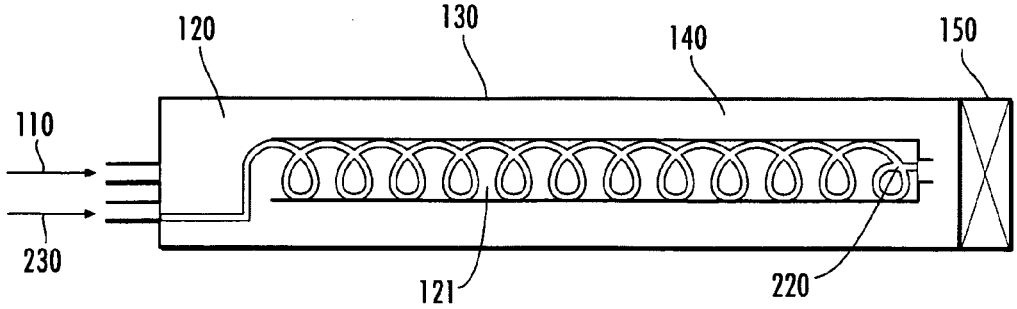
Figure 34:
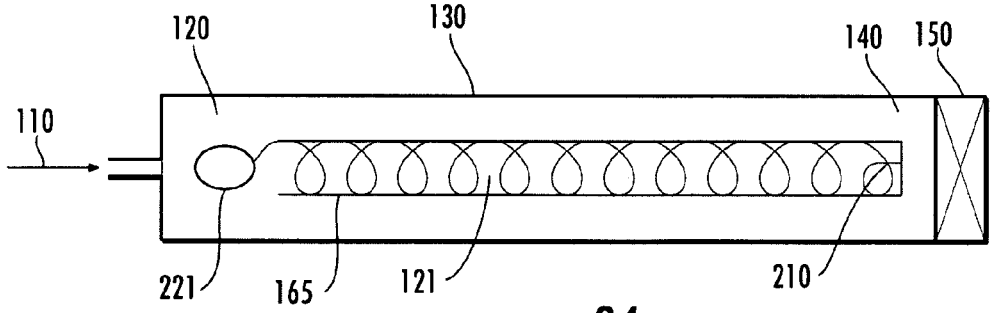
Figure 35:
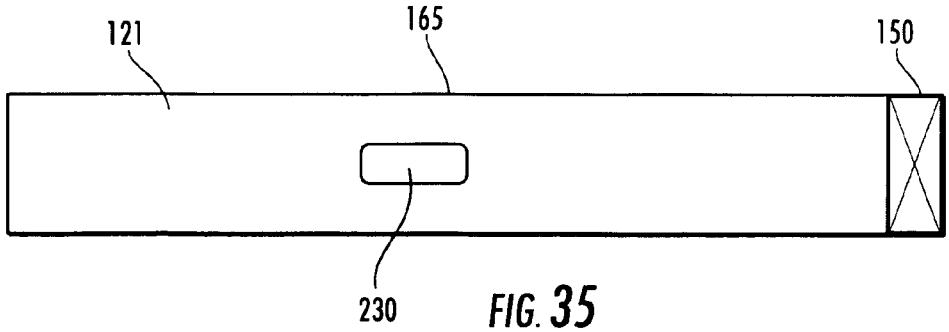
Figure 36:
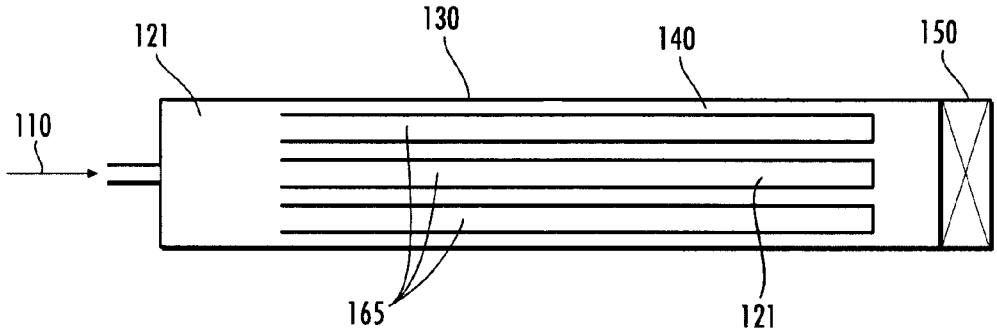

Other embodiments of the projectile propulsion system are illustrated in FIGS. 12-36. These Figures include multiphase material 120, a launch tube 130, compressed gas 140 in porous spaces of the multiphase material, a membrane 150, and a projectile 160. FIG. 12 illustrates a cross-section of the apparatus for launching projectile(s). FIGS. 12-14 illustrates the system having a gas inlet 110. FIG. 14 illustrates the projectile can be hollow. FIG. 15 illustrates the outer surface of the projectile having ridges to achieve increased surface friction force and range. FIG. 16 illustrates the projectile being located inside an outer body shell that is covered with circular ridges to achieve increased surface friction force and decreased aerodynamic resistance forces during the time of flight. FIG. 17 illustrates the inner surface of launch tube has circular ridges to achieve decreased recoil. FIG. 18 illustrates the launch tube having multiple passive projectiles. FIGS. 19-21 illustrate various objects may be attached to the projectiles, such as a net, rope or chain, respectively. FIGS. 22-23 illustrate the projectile being guided inside the launch tube by linear longitudinal ridges or spiral ridges, respectively, along the longitudinal axis of the launch tube. FIGS. 24-26 illustrate the launch tube having several gas inlets to pressurize the launch tube. FIG. 25 illustrates having a membrane to partially or non-hermetically seal the launch tube. FIG. 26 illustrates the launch tube having no membrane sealing the launch tube. FIG. 27 illustrates inserting chemicals or chemical charges into the interior of the launch tube to cause chemical reactions within the launch tube. FIGS. 28-31 illustrate the launch tube being active, which means that the launch tube itself becomes a projectile upon activation or breaking of the membrane. FIG. 29 illustrates a gas inlet located on the membrane. FIG. 30 illustrates separating plates within the launch tube for preventing motion of the non-cohesive loose granular multiphase material inside the interior of the launch tube under the influence of inertial forces. FIG. 31 illustrates aerodynamic control surfaces on the launch tube's outer surface. FIG. 32 illustrates an active projectile with anchoring foldable or fixed hooks attached to the outer surface of the projectile. FIG. 33 illustrates an active projectile located inside the launch tube, where the active projectile has with a hose inside a chamber of the active projectile. FIG. 34 illustrates a flexible cord or rope being fixed to one end of the active projectile inside the launch tube and a movable weight, charge, an anchor or another payload attached to the other end of the active projectile. FIG. 35 illustrates an active projectile and compressed gas being produced by a chemical charge which is located inside the interior of the active projectile. FIG. 36 illustrates several active projectiles which are located inside a launch tube. It should be understood that other embodiments may also be employed.

The flowcharts and block diagrams in the Figures illustrate the architecture, functionality, and operation of possible implementations of systems and methods according to various embodiments of the present invention. In this regard, each block in the flowchart or block diagrams may represent a module, segment, or portion of code, which comprises one or more executable steps for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems which perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein

What is claimed is:

1. A method for propulsion, comprising:

filling an interior cavity of a tube with a multiphase material, wherein the tube comprises sidewalls, a back wall and an opening, wherein the back wall is opposing the opening, and wherein the multiphase material comprises a multiphased composite structure comprising a multiplicity of elements together;

disposing a projectile into the interior cavity of the tube such that the projectile is directly surrounded by the multi-phase material;

sealing the opening of the tube with a membrane while the multi-phase material and projectile are disposed in the interior cavity of the tube;

pressurizing the sealed tube with a gas while the tube is sealed and prior to launching the projectile; and prior to launching the projectile, breaking the membrane thereby equalizing the pressure from the interior cavity with pressure on the exterior of the tube and also thereby resulting in a first shock wave and a second shock wave, the first shock wave emanating away from the projectile and a second shock wave traveling down the tube and reflecting from the back wall of the tube to facilitate pushing propelling the projectile out of the tube.

2. The method of claim 1, wherein the gas comprises air.

3. The method of claim 1, wherein, in response to the breaking of the membrane, the shockwave travels through the multiphased material, thereby breaking up the multiphased material proximate the back wall and causing the multiphased material to be propelled against the projectile so that the projectile is pushed out of the tube.

4. The method of claim 1, wherein the multiphase material comprises sand.

5. The method of claim 1, wherein the projectile comprises at least one propulsion system, wherein the propulsion system comprises a tube, multiphase material, another projectile and a removable barrier.

6. The method of claim 1, wherein the membrane comprises a removable pressure barrier, and wherein the tube is pressurized to 35,000,000 Pa prior to breaking the removable barrier.

7. A method comprising:

providing a projectile propulsion system comprising a tube comprising an interior cavity and an opening;

disposing multi-phase material in the interior cavity, wherein the multiphase material comprises a multiplicity of elements together;

disposing a projectile into the interior cavity of the tube such that the projectile is surrounded by the multi-phase material;

sealing the opening of the tube with a removable barrier while the multi-phase material and projectile are disposed in the interior cavity of the tube;

pressurizing the sealed tube with a gas while the tube is sealed and prior to launching the projectile; and prior to launching the projectile and after pressuring the sealed tube, removing the removable barrier to allow equalization of pressure from outside of the launch tube and the interior cavity of the launch tube so that when the removable barrier is removed, the projectile is launched from the tube.

8. The method of claim 7, wherein the tube comprises sidewalls, a back wall and an opening, wherein the back wall is opposing the opening, and wherein the multiphase material comprises a multiphased composite structure comprising a multiplicity of elements bonded together.

9. The method of claim 8, wherein the gas comprises air.

10. The method of claim 7, wherein prior to launching the projectile, removing the barrier thereby equalizing the pressure from the interior cavity with pressure on the exterior of the tube and also thereby resulting in a first shock wave and a second shock wave, the first shock wave emanating away from the projectile and a second shock wave traveling down the tube and reflecting from the back wall of the tube to facilitate pushing and propelling the projectile out of the tube.

11. The method of claim 7, wherein the removing the removable barrier comprises breaking a membrane, and wherein the breaking of the membrane comprises heating the membrane.

12. A method of manufacturing a projectile propulsion system, comprising: providing a tube comprising an interior cavity and an opening; disposing multiphase material and a projectile in the interior cavity, wherein the multiphase material comprises sand; pressurizing the interior cavity to 35,000,000 Pa prior to breaking a membrane or removing a barrier and prior launching of the projectile; and sealing the opening so that the interior cavity stays pressurized so that when the membrane is broken or barrier is removed, the multiphase material and a shock wave launches the projectile from the tube.

13. A system of a multiphase projectile propulsion system, comprising: a tube comprising an opening and an interior cavity defined by sidewalls and a back wall, wherein the back wall is opposing the opening; multi-phase material disposed in the interior cavity, wherein the multiphase material comprises a multiphased composite structure comprising a multiplicity of elements together; a projectile disposed into the interior cavity of the tube such that the projectile is directly surrounded by the multi-phase material, wherein the projectile comprises at least one propulsion system, wherein the propulsion system comprises a tube, multiphase material, another projectile and a removable barrier; and a pressure barrier or membrane configured to seal the opening while the multi-phase material and projectile are disposed in the interior cavity of the tube, wherein membrane allow pressurization of the tube with a gas while the tube is sealed and prior to launching the projectile, and wherein prior to launching the projectile, breaking the membrane or removing the pressure barrier equalizes the pressure from the interior cavity with pressure on the exterior of the tube and also thereby resulting in a first shock wave and a second shock wave, the first shock wave emanating away from the projectile and a second shock wave traveling down the tube and reflecting from the back wall of the tube to facilitate pushing propelling the projectile out of the tube.

* * * * *